US005272955A

United States Patent [19]

Bond et al.

[11] Patent Number: 5,272,955

[45] Date of Patent: Dec. 28, 1993

[54] GUN AIMING DEVICE FOR A WHEELCHAIR

[76] Inventors: Robert L. Bond, 3450 E. Ridge Ct., NE., Grand Rapids, Mich. 49506; Bradford S. Bachelder, 1230 Worcester Dr., NE., Grand Rapids, Mich. 49505

[21] Appl. No.: 916,187

[22] Filed: Jul. 17, 1992

[51] Int. Cl.[5] ..... F41A 23/58

[52] U.S. Cl. ..... 89/37.04; 89/41.12; 89/44.01

[58] Field of Search ..... 42/94; 89/37.07, 37.04, 89/37.13, 37.14, 44.01, 41.12

[56] References Cited

U.S. PATENT DOCUMENTS

| | | | |
|---|---|---|---|
| 2,350,662 | 6/1944 | Adams et al. | 89/41.12 |
| 2,388,010 | 10/1945 | Pohl | 89/41.12 |
| 2,582,140 | 1/1952 | Leek | 42/94 |
| 3,249,387 | 5/1966 | Pivacek . | |
| 4,012,860 | 3/1977 | Auger | 42/94 |
| 4,440,061 | 4/1984 | Magnuson | 89/37.07 |
| 4,937,965 | 7/1990 | Narvaez | 42/94 |

OTHER PUBLICATIONS

Sales document enttitled "Finally a Shooting Rest for the Quad" published by SR-77 Enterprises, Inc. of Chadron, Nebraska 69337, publication date unknown.

An article entitled "Modified Hunting Rifle for a Quadriplegic", written by Andrew Szeto, Professor of Louisiana Tech. University, Ruston, Louisiana 71272, published Sep. 1978.

*Primary Examiner*—Stephen M. Johnson

*Attorney, Agent, or Firm*—Price, Heneveld, Cooper, DeWitt & Litton

[57] ABSTRACT

A portable apparatus attachable to a wheelchair for movably supporting a gun thereon includes a pneumatic/hydraulic fluid operated control circuit for operably controlling the direction of the gun while sitting in the wheelchair. The apparatus includes a support adapted to attach to the wheelchair and support a gun, and further includes a control system including a hydraulic linear actuator and a hydraulic rotary actuator operably connected to the support, an air tank operably connected through control valves and air/oil chambers to the actuators, and controls including a joystick which can be readily manipulated by the person in the wheelchair to move the control valves and thereby controllably actuate the actuators to aim the gun. A pair of oil interlock valves are operably connected to either side of each of the actuators to securely locate the gun in a given position once aimed.

34 Claims, 3 Drawing Sheets

GUN AIMING DEVICE FOR A WHEELCHAIR

BACKGROUND OF THE INVENTION

The present invention relates to a gun aiming apparatus attachable to a wheelchair, and in particular to an apparatus attachable to a wheelchair for supporting and controlling a gun in a way that allows a person sitting in the wheelchair to aim and fire the gun.

Many people enjoy target shooting and hunting with a gun. The same is true for people confined to a wheelchair. Further, the enjoyment and pride of such hobbies can be particularly important to a person confined to a wheelchair since it provides a challenging and interesting activity for the person, and also motivates the person to venture outdoors and become active.

Recently, some devices have been constructed to operably attach a gun to a wheelchair so that a person confined to the wheelchair can aim and fire the gun, even if the person has limited upper body mobility. The known devices are electrical in nature, and are driven by battery powered electrical controls However, these systems can be adversely affected by temperature changes, and are subject to failure from shock and/or vibration from firing the gun. Also, improvements are desired in the accuracy and ease of control by the wheelchair-bound person. Still further, batteries take a relatively long time to recharge, which can be frustrating if further use of the gun aiming device is desired.

Thus, an improved apparatus is desired solving the aforementioned problems.

SUMMARY OF THE INVENTION

The present invention includes an apparatus for use by a person to aim and fire a gun while sitting in the wheelchair. The apparatus includes a base adapted to attach to the wheelchair, and a gun support adapted to securely attach to and support a gun, the gun support being movably connected to the base so that the gun can be aimed in different directions. At least one fluid operated actuator is operably connected between the base and gun support for moving the gun support to aim the gun. A control means operably connects a powering means to the actuator for controlling the actuator, the control means being adapted for use by the wheelchair-bound person.

In the preferred embodiment, the apparatus also includes a firing means for firing the gun, the firing means being adapted for use by the handicapped person. Also in the preferred embodiment, the apparatus includes shock absorbers for supporting the gun to minimize shock transfer to the apparatus and wheelchair when the gun is fired. Still further, the pack in the preferred embodiment facilitates quick assembly to a wheelchair.

The preferred embodiment of the present invention offers several advantages over known art. The preferred embodiment utilizes fluid power which is durable, and withstands the vibration from repeated firing of a gun. Further, the powering and control system is relatively light in weight with the air tank and fluid controls weighing considerably less than an equivalent electrical powering and control system including one or more 12 volt batteries and multiple electrical solenoids/motors/controls. Still further, the fluid based system is less sensitive to temperature changes. Additionally, the air tank can be quickly recharged in only a few minutes. At the same time, the air/oil chamber allows incompressible fluid to be used to control the actuator for aiming the gun, giving accurate control over aiming the gun.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
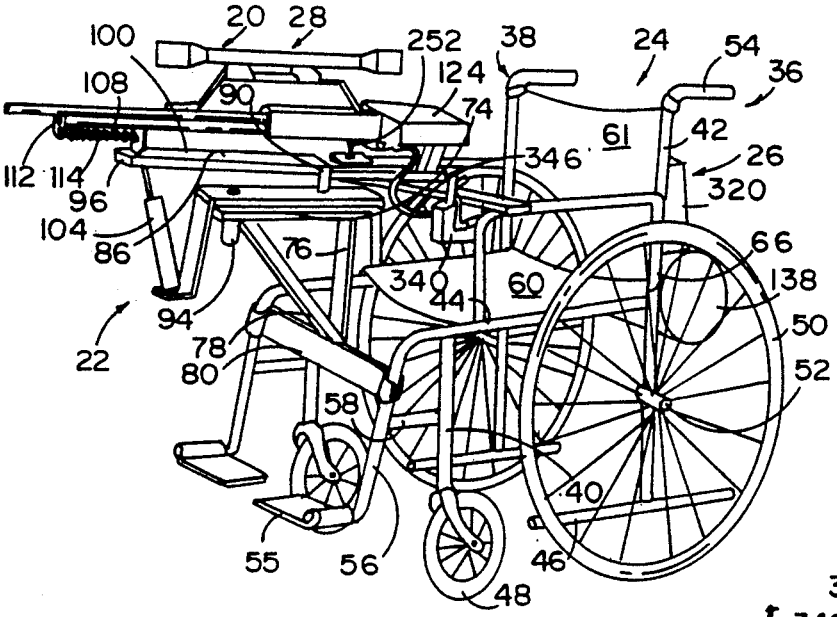
FIG. 1 is a perspective view of an apparatus to aim and fire a gun embodying the present invention, the apparatus being shown as installed on a wheelchair.
Figure 5:
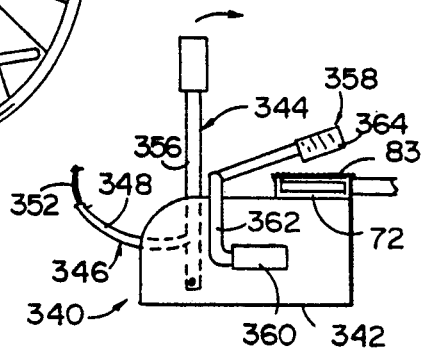
FIG. 5 is a fragmentary side view of the safety and remote trigger for firing the gun.
Figure 2:
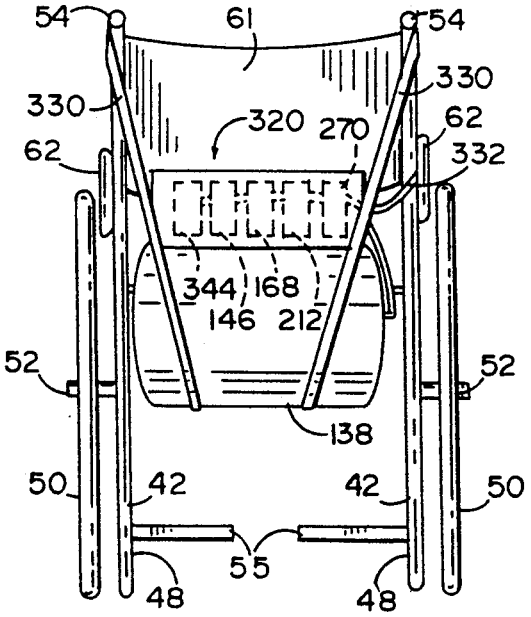
FIG. 2 is a rear view of the apparatus and wheelchair illustrated in FIG. 1.
Figure 6:
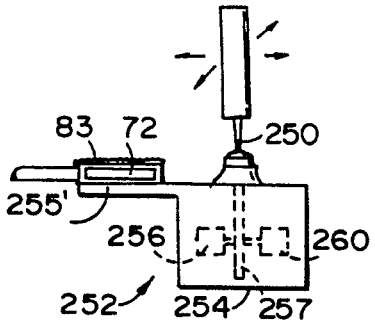
FIG. 6 is a side view of the joystick for aiming the gun.
Figure 3:
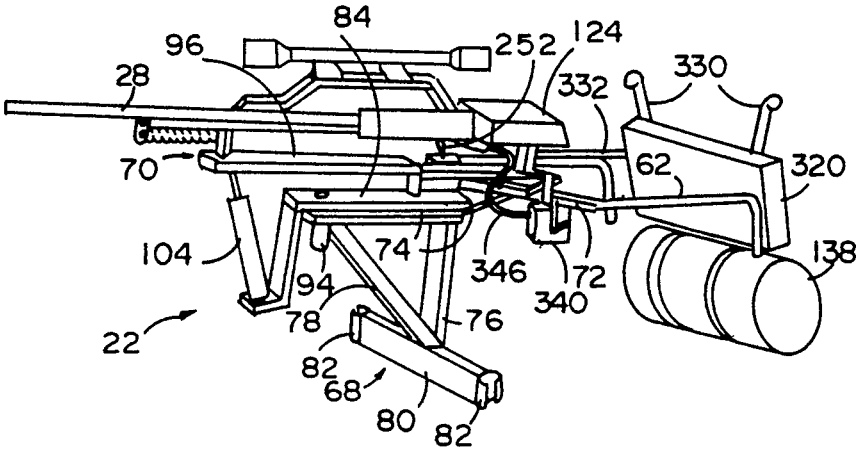
FIG. 3 is a perspective view of the apparatus illustrated in FIG. 1 separate from the wheelchair.

For the purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that these specific devices and processes illustrated in the attached drawings and described in the following specification are simply exemplary embedments of the inventive concepts defined in the appended claims. Hence, specific dimensions and other physical characteristics relating to the embodiments disclosed herein are not to be considered as limiting unless the claims expressly state otherwise.

An apparatus embodying the present invention is shown in FIG. 1, and is generally referred to by the numeral 20. Apparatus 20 includes a support assembly 22 that is adapted to attach to a wheelchair 24, and further includes a portable control system 26 (FIGS. 2–6) which operably attaches to support assembly 22 to controllably move a gun such as rifle 28 having a modified stock (FIG. 4) mounted on support assembly 22, thus allowing a person sitting in wheelchair 24 to aim and then fire gun 28. Apparatus 20 is relatively lightweight so that it can be readily positioned on wheelchair 24 with some or all of components being placed on wheelchair 24 after the person is placed in the wheelchair 24, as described below. Also, the control system is durable so that the system is not as subject to failure from vibration when firing gun 28, as other systems may be. Still further, control system 26 is relatively unaffected by temperature variation, but offers the advantage of long use time with quick recharge.

It is contemplated that apparatus 20 can be readily adapted for a variety of different wheelchairs. The particular wheelchair 24 illustrated in FIG. 1 includes a tubular frame having opposing side subframes 36 and 38 which are substantially mirror images of each other. Subframe 36 includes front and rear vertical posts 40 and 42 interconnected by horizontal main seat side beam 44 and lower stabilizer post 46. A front wheel 48 is operably connected to the bottom of front vertical post 40, and a rear wheel 50 is operably connected to a lower portion of rear vertical posts 42 on axle 52. The upper portion of rear vertical post 42 extends rearwardly forming a push handle 54 for an attendant person pushing the wheelchair. Horizontal main seat side beam 44 includes a forward portion 56 which extends forwardly and downwardly from the upper end of front posts 40. A footrest platform 55 is operably connected to the end of forward portion 56, and a stabilizer bar 58 connects forward portion 56 with front vertical post 40 for increased stability. A seat bottom 60 is formed by securing a sheet of flexible material between seat side beams 44 and a seatback 61 is formed by securing a similar sheet of flexible material between rear vertical posts 42.

A removable armrest 62 attaches to main seat side beam 44 at a front location 64 and at a rear location 66 (FIG. 1). Apparatus 20 incorporates removable armrests 62 into its structure to facilitate installation of apparatus 20 onto wheelchair 24, but it is contemplated that apparatus 20 could merely attach to an existing armrest if desired. Notably, depending upon the stiffness of wheelchair subframes 36 and 38, apparatus 20 need only be attached at rear location 66, thus further simplifying attachment of apparatus 20 to wheelchair 24.

Support assembly 22 (FIGS. 3 and 4) includes a lower base 68 which securely attaches to wheelchair 24 and a gun support 70 which operably connects to base 68 and gun 28 in a manner that allows gun 28 to be adjustably aimed. In particular, base 68 includes an upper cross brace 72 that is securely attached to a pair of spaced apart removable armrests 62, one armrest 62 being located on each end of cross brace 72. Cross brace 72 is located at a forward position on armrests 62 so that cross brace 72 is positioned above the thighs of a person sitting in wheelchair 24 when armrests 62 are secured to wheelchair frame 24. A center bar 74 connects to the center of cross brace 72 and extends forwardly. A vertical support beam 76 and forwardly angled beam 78 are welded to center bar 74 and form a rigid triangular shape form with a forward portion of center bar 74. A second cross brace 80 is welded to the lower end of beams 76 and 78 where they intersect, cross brace 80 including opposing ends 82 adapted to clampingly attach to forward portions 56 of wheelchair side beams 44. At least upper cross brace 72 is covered with a padding 83 so that the person in wheelchair 24 can comfortably rest their hands or wrists on cross brace 72 when using apparatus 20.

Gun support 70 (FIG. 4) includes a "Z"-shaped intermediate support 84 having segments 86, 88 and 90 bolted together, with the middle segment 86 being located above and parallel to center bar 74, the front segment 88 hanging downwardly in front of center bar 74, and the rear segment 90 rising above center bar 74. Intermediate support 84 is pivotally connected to the forward end of center bar 74 by a rotary actuator 94, rotary actuator 94 providing rotational windage right and left adjustment of gun 28 and its supporting framework 70. The weight of gun 28 and frame 70 bears on bushing detail 77A which is connected to rotary actuator by a Trantorque ® device. It is contemplated that a rotary actuator can be satisfactorily used such as a pneumatic rotary vane actuator sold under the trade name TURN-ACT ® by Turn-Act Company, Jeffersontown, Kty. Notably, it is contemplated that the pivotal connection may be made anywhere along center bar 74 however it is preferable that the axis of rotation be close to the rear-ward end of the scope on gun 28 so that minimal head movement is needed by the person in wheelchair 24. Also, it is contemplated that various alternative rotary driving mechanisms could also be used such as a rotatable pivot bearing with a linear actuator connected to a rack-and-pinion type drive mechanism.

Figure 4:
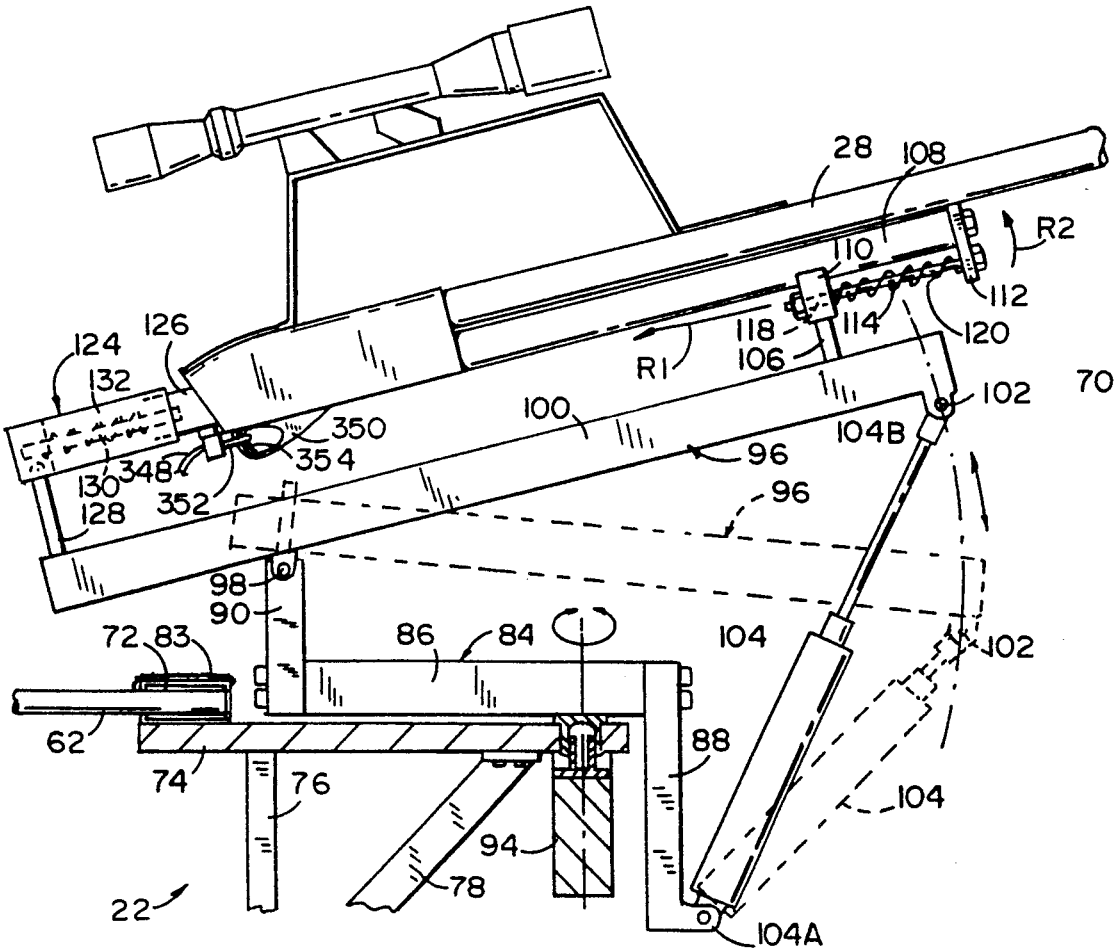
FIG. 4 is a fragmentary side view of the apparatus illustrated in FIG. 3.

Gun support 70 also includes a gun rest/attachment bracket 96 (FIG. 4). Bracket 96 has an elongate bar-like body 100 with a rear pivot 98 that operably pivotally connects to the top of rear segment 90, and further includes a front pivot 102. A linear actuator or hydraulic cylinder 104 includes a cylinder end 104A pivotally connected to front segment 88 of Z support 84 and a rod end 104B pivotally connected to front pivot 102 of attachment bracket 96. This mechanism provides elevational adjustment for up and down movement.

Gun 28 is operably mounted to gun rest/attachment bracket 96 at a front and rear location. In the front, a "Y"-shaped stanchion 106 extends upwardly from body 100, with the magazine 108 of gun 28 resting in the arms 110 of "Y"-shaped stanchion 106. A flat link 112 is attached to the forward end of gun magazine 108, and a rod 114 is loosely connected to link 112 and is extended rearwardly loosely and slideably through a hole 118 at the base of arms 110 of front stanchion 106. A coil spring 120 is placed on rod 114 and acts as a shock absorber when gun 28 is fired, spring 120 both absorbing energy and also biasingly returning gun 28 to a forward position after the energy is dissipated.

In the rear, a stanchion 128 extends upwardly from body 100 and pivotally connects to a rear shock absorber block 124. A mating shock absorber block 126 connects to gun 28 at a location where the stock or butt (not shown) of gun 28 normally connects to gun 28. A pair of spaced rods 130 extend between blocks 124 and 126, rods 130 being slideably mounted in block 126, and a pair of coil springs 132 are placed on rods 130 between blocks 124 and 126. Rods 130 are spaced apart on either side of the butt of gun 28 so that gun 28 can move rearwardly partially between rods 130 on recoil. This also provides a balanced support of gun 28 during firing. Thus, all springs 120 and 132 absorb the energy from the recoil of gun 28 upon firing. Notably, the looseness in link 112, rod 114 and front support hole 118 permits some upward movement of the gun barrel 134 about rear pivot 98 immediately after firing gun 28. The arrow R1 indicates the primary barrel movement on recoil and the arrow R2 indicates the limited upward movement permitted by link 112, rod 114 and front support hole 118. Though a particular mechanical shock absorber arrangement is shown, it is contemplated that various shock absorbing arrangements can be used such as hydraulic, orifice type shocks which would reduce wear points and number of components.

The control system of apparatus 20 (FIG. 7) includes a compressed air tank 138 of about 1-2 cubic feet in size, which tank is made up of lightweight aluminum or the like. A pressure gage 139 is connected to tank 138 to sense the air pressure therein. Tank 138 is connected through air filter/regulator 140 to T connector 142 to directional pneumatically operated control valves 144 and 146. In particular, air line 148 extends from T connector 142 to inlet port 150 of directional control valve 144. Valve 144 also includes two actuator ports 152 and 154, and two outlet ports 156 and 158, outlet ports 156 and 158 each including an exhaust muffler for exhausting compressed air to atmosphere Valve 144 includes a three position spool 160 which is normally spring biased to a center position, but which is movable sideways in either of two different directions to an "extend" or "retract" position by pressuring pneumatic control ports 162 or 164, respectively. With spool 160 in the center position, ports 150, 152 and 154 are blocked. With spool 160 shifted to the extend position (to the right in FIG. 7), compressed air is communicated from inlet port 150 to actuator port 152, and actuator port 154 is connected to outlet port 158 to exhaust. With spool 160 shifted to the retract position (to the left in FIG. 7), compressed air is communicated from inlet port 150 to actuator port 154, and actuator port 152 is connected to outlet port 156 to exhaust.

Air line 166 is connected to actuator port 152, and communicates compressed air to the pneumatic port on air/oil chamber or tank 168, which chamber 168 is adapted to convert compressed air energy to hydraulic energy (i.e. incompressible fluid flow) and visa-versa. Similarly, an air line 170 connects actuator port 154 to an air/oil chamber 172, air/oil chamber or tank 172 being similar in operation to air/oil chamber 168. The oil or hydraulic port on air/oil chamber 168 is connected in series to an oil line 176, a spring biased normally closed blocking-type interlock valve 178 and to the piston side of linear actuator 104. Also, the oil or hydraulic port on air/oil chamber 172 is connected in series to an oil line 186, a spring biased normally closed blocking-type interlock valve 188, and to the rod end of linear actuator 104.

An air line 192 extends from T connector 142 to inlet port 194 of directional control valve 146. Valve 146 includes two actuator ports 196 and 198 and includes two outlet ports 200 and 202 including an exhaust muffler for exhausting compressed air to atmosphere. Valve 146 includes a three position spool 204 that is normally spring biased to a center position, which is movable sideways in either of two different directions to a "rotate clockwise" or "rotate counterclockwise" position by pressurizing pneumatic control ports 206 or 208, respectively. With spool 204 in the center position, ports 194, 196 and 198 are blocked. With spool 204 shifted to the "rotate clockwise" position (to the right in FIG. 7), compressed air is communicated from inlet port 194 to actuator port 196, and actuator port 198 is connected to outlet port 202 and to exhaust. With spool 204 shifted to the "rotate counterclockwise" position (to the left in FIG. 7), compressed air is communicated from inlet port 194 to actuator port 198, and actuation port 196 is connected to outlet port 200 and to exhaust.

An air line 210 is connected to actuator port 196 and communicates compressed air to the pneumatic port on an air/oil chamber 212. Compressed air fluid flow is converted to incompressible fluid flow in an air/oil chamber or tank 212. Similarly, an air line 214 connects actuator port 198 to the pneumatic port on an air/oil chamber 216. The hydraulic port on air/oil chamber 212 is connected in series to an oil line 220 and through a spring biased normally closed blocking-type interlock valve 222 to one side of rotary actuator 94. Also, the hydraulic port on air/oil chamber 216 is connected in series to an oil line 226, a spring biased normally closed blocking-type interlock valve 228 and to an opposite side of rotary actuator 94. Notably, it is contemplated that air/oil tanks such as those made by C & C Manufacturing of Rockford, Ill. will provide satisfactory air/oil chambers 168, 172, 212 and 216. Also, blocking fittings 178, 188, 222 and 228 directly attachable to actuators 94 and 104 can be used.

Directional control valves 144 and 146 and interlock valves 178, 188, 222 and 228 are controlled by manipulating a lever 250 on joystick 252. Joystick 252 (FIG. 6) includes a box-like housing 254 with lever 250 operably pivotally mounted to housing 254 at pivot 257 so that lever 250 can be moved multidirectionally to multiple angular positions. Four spring-biased normally closed switching valves 256, 258, 260 and 262 are located around lever 250 with valves 256 and 260 opposing each other and valves 258 and 262 (not shown in FIG. 6 for clarity) opposing each other. Switching valves 256, 258, 260 and 262 (FIG. 7) can be individually activated as lever 250 is moved in the direction of a particular switching valve. For example, if lever 250 is pivotally moved toward switching valve 256, switching valve 256 is activated. Also for example, if lever 250 is moved at an angle toward both switching valve 256 and 258, both valves 256 and 258 are activated. It is contemplated that joystick 252 is a purchasable item, and is referred to as a four-direction, spring-return-to-center pneumatic joystick operator with normally non-passing switching.

Figure 8:
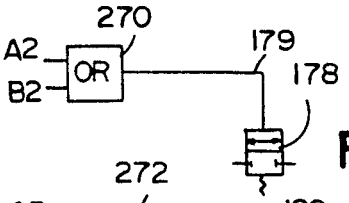
FIGS. 8–11 are schematic diagrams of the logic valves used in the fluid control circuit for the apparatus shown in FIG. 3.
Figure 9:
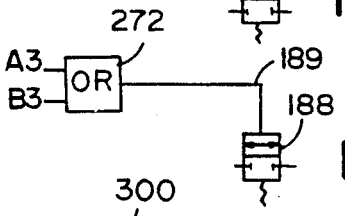

Switching valve 256 (FIG. 4) is operably connected to the compressed air in tank 138 by control supply line 263 and 264, lines 263 and 264 being about a 4 mm diameter logic size control line and typical of the control lines used. Switching valve 256, when activated by movement of lever 250, communicates compressed air through control line A1 to pneumatic control port 162 on directional control valve 144 causing spool 160 to shift. A connector 266 is connected to control line A1 so that when line A1 is pressurized, pressure is also communicated from connector through lines A2 and A3 to the "OR" logic valves 270 and 272 (FIGS. 8 and 9). Logic valves 270 and 272 are operably connected to interlock valves 178 and 188, respectively, through lines 179 and 189, respectively. Thus, logic valves 270 and 272 open interlock valves 178 and 188 when energized.

Switching valve 260 is also operably connected to the compressed air in tank 138 by control supply lines 268 and 263. Switching valve 260, when actuated by movement of lever 250, communicates compressed air through a control line B1 to pneumatic control port 164 on directional control valve 144, causing spool 160 to shift. A connector 284 is connected to control line B1 so that when line B1 is pressurized, pressure is also communicated from connector 284 through lines B2 and B3 to "OR" logic valves 270 and 272, respectively. Thus, both of interlock valves 178 and 188 are opened when either of switching valves 256 or 260 are energized.

Figure 10:
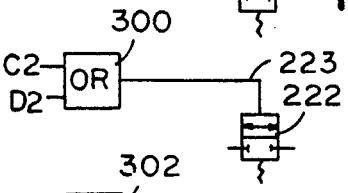
Figure 11:
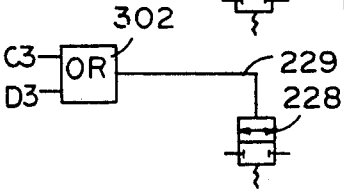

Switching valve 258 is also operably connected to the compressed air in tank 138 by a control supply line 290. Switching valve 258, when actuated by movement of lever 250, communicates compressed air through control line C1 to pneumatic control port 206 on directional control valve 146, causing spool 204 to shift. A connector 294 is connected to control line C1 so that when line C1 is pressurized, pressure is also communicated from connector 294 through lines C2 and C3 to "OR" logic valves 300 and 302, respectively (FIGS. 10 and 11). Logic valves 300 and 302 are operably connected to open interlock valves 222 and 228 when energized.

Switching valve 262 is operably connected to the compressed air in tank 138 by control supply line 310. Switching valve 262, when actuated by movement of lever 250, communicates compressed air through control line D1 to pneumatic control port 208 on directional control valve 146, causing spool 204 to shift. A connector 314 is connected to control line D1 so that when line D1 is pressurized, pressure is also communicated from connector 314 through lines D2 and D3 to "OR" logic valves 300 and 302, respectively. Thus, interlock valves 222 and 228 are opened by actuation of either switching valve 258 or 262.

It is contemplated that compressed air tank 138 and a modular control pack 320 (FIG. 2) will be attached by straps 330 to handles 54 of the wheelchair on the backside of seatback 61. It is contemplated that modular control pack 320 can be constructed of any lightweight material, such as the canvas-like material of seatback 61, with a stiff bottom being positioned therein so that components stored therein do not bump damagingly against one another when moving wheelchair 24. Pack 320 has one or more pockets (FIG. 2) for receiving components, such .as directional control valve 144; directional control valve 146; air/oil chambers 168, (172) and 212 (and 216); and logic valves 270 (and 272, 300 and 302). It is contemplated that interlock valves 178, 188, 222 and 228 could also be positioned in pack 320, however, these valves are presently mounted directly on actuators 94 and 104. A conduit 332 is routed from pack 320 along RH arm 62 to an end of upper cross brace 72 where joystick 252 is mounted. Conduit 332 protectingly houses compressed air and fluid lines as needed as the lines extend from pack 320 to joystick 252 for the operation of control system 26. Additional fluid lines are routed from joystick 252 to actuators 94 and 104 along base 68 as needed. Notably, various components of control system 26 can be mounted on base 68 or in modular control pack 320 as desired for optimum weight distribution and for maximum design efficiency.

Figure 7:
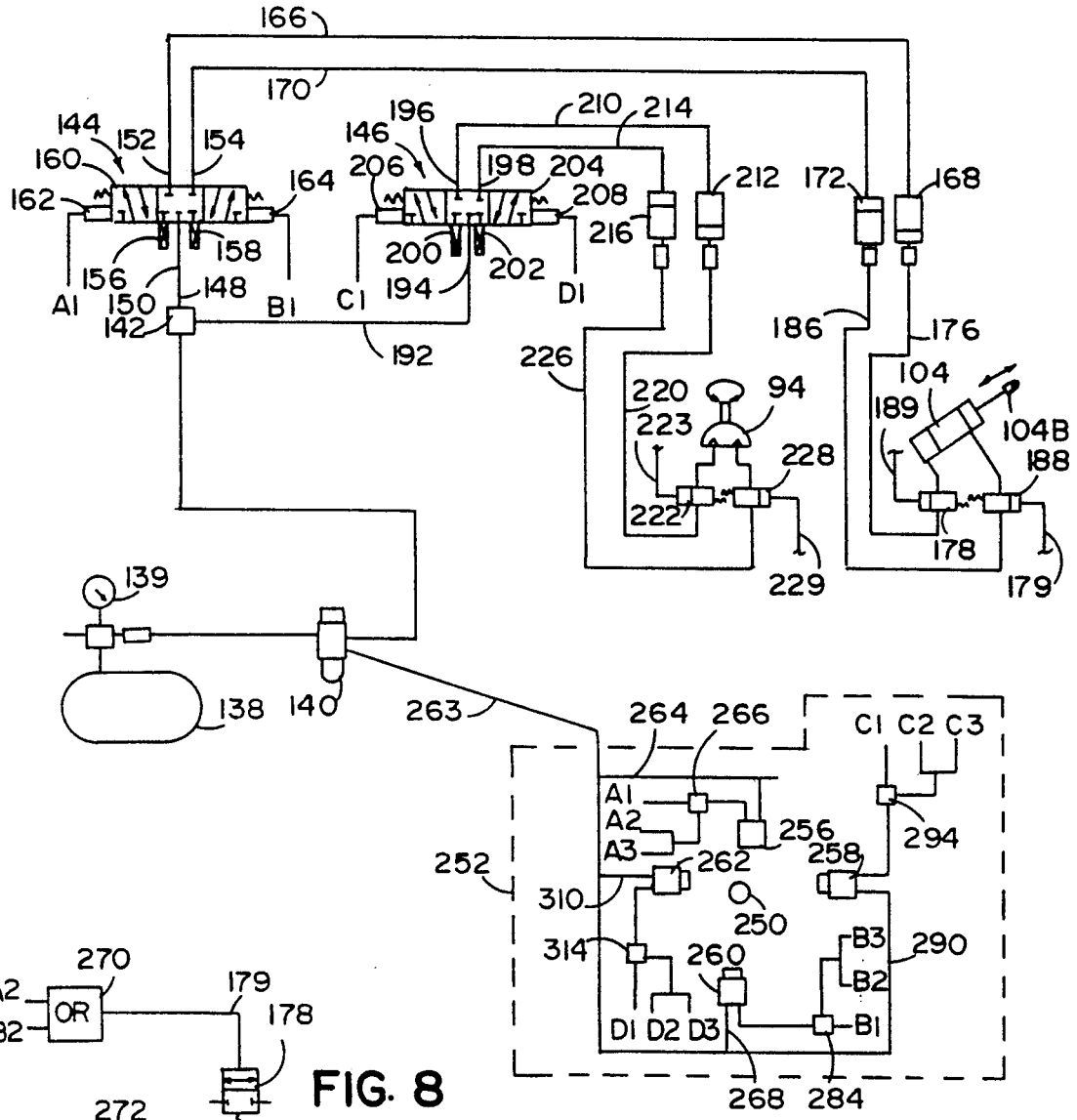
FIG. 7 is a pneumatic/hydraulic schematic diagram of the fluid power control for the apparatus illustrated in FIG. 3.

Housing 254 of joystick 252 (FIG. 6) is mounted by bracket 255 to the underside of upper cross brace 72. Joystick 252 is located on the RH side of upper cross brace 72 and in front thereof so that a person can rest their wrist or hand on upper cross brace 72 when using apparatus 20. As noted above, joystick lever 250 is pivotally mounted to housing 254 at pivot point 257, with switching valves 256, 258, 260 and 262 being positioned around lever 250. For the sake of clarity, only switching valves 256 and 260 are shown in FIG. 7. Joystick lever 250 extends above upper cross brace 72 so that lever 250 can be easily manipulated as desired while resting one's forearm or wrist on upper cross brace 72. Notably, the degree of an operator's disability determines the method of final control valve actuation. For example, the joy stick 252 could be replaced by a different control package such as a sip/puff diaphragm control device.

The firing mechanism 340 (FIGS. 1 and 5) is mounted on the LH end of upper cross brace 72 and in front thereof. Firing mechanism 340 includes a housing 342 mounted to upper cross brace 72, and a trigger lever 344 pivotally mounted to housing 342. A cable 346 includes an outer sheath 348 attached to housing 342 and to block 126 adjacent gun trigger protector 350 (FIG. 4) and further includes an inner slideable cable 352 operably attached to lever 344 and to gun trigger 354. Lever 344 also includes an upstanding handle 356 that can be pulled to slideably move inner cable 352 rearwardly, thus pulling gun trigger 354 and firing gun 28.

A safety bar 358 is pivotally mounted to a side of housing 342 by pivot bearing 360. Safety bar 358 includes a first segment 362 that abuts lever 344 preventing any movement of lever 344 when safety bar 358 is in the "ON" position, but is pivotable outwardly to an "OFF" position so that lever 344 can be moved to fire the gun 28. Safety bar 358 is constructed so that gravity tends to hold bar 358 in the selected "ON" or "OFF" position. Safety bar 358 also includes an upwardly oriented handle 364 so that the safety bar 358 can be readily moved between positions by a person having limited mobility of their fingers.

Having described the preferred embodiment of the present invention, the operation of the embodiment will become obvious to one of ordinary skill in the art. With a person sitting in wheelchair 24, the wheelchair armrests are removed, and support assembly 22 is attached to the wheelchair. In particular, base 68 is attached to wheelchair by use of integral arms 62 attached to upper cross brace 72, and lower cross brace 80 is attached to wheelchair subframes 36 and 38. Modular control pack 320 is then strapped to wheelchair subframes 36 and 38 behind wheelchair seatback 61.

The joystick 252 is thus positioned at the front of the RH armrest 62 where it allows a person sitting in wheelchair 24 to control the aiming of gun 28 by manipulating lever 250. For example, by manipulating lever 250 rearwardly, switching valve 256 is activated causing the fluid power system to unlock and then extend actuator 104 thus raising gun 28 to aim the gun at a higher angle. Also by example, by manipulating lever 250 toward either of switching valves 258 or 262, the angle of gun 28 is controllably adjusted from side-to-side. With gun 28 properly aimed, gun safety bar 358 can be moved out of the way and firing lever 344 pulled to actuate gun trigger 354 and fire gun 28.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An apparatus for sue by a wheelchair-bound person to aim and fire a gun while sitting in a wheelchair comprising:

a base adapted to attach to the wheelchair;

a gun support adapted to securely attach to and support the gun, said gun support being movably connected to said base so that the gun can be aimed in different directions;

at least one fluid operated actuator operably connected to said gun support for controllably moving the gun to aim the gun;

fluid power means for powering said one actuator including means for mounting said fluid power means to the wheelchair; and control means operably connected to said fluid power means and said one actuator for controlling said one actuator, said control means being adapted for use by the wheelchair-bound person.

2. An apparatus as defined in claim 1 wherein said control means includes a lever operably connected to said fluid power means and adapted to be manipulated by the wheelchair-bound person to control said one actuator, whereby the wheelchair-bound person can manipulate said lever to aim the gun.

3. An apparatus as defined in claim 2 wherein said control means includes at least one directional valve operably connected to said lever and to said one actuator so that by manipulating said lever, said one directional valve can be shifted and the gun can be aimed.

4. An apparatus as defined in claim 3 wherein said at least one actuator includes a first actuator and a second actuator, and also wherein said control means includes a first directional valve and a second directional valve, said first actuator and said first directional valve being operably interconnected with each other and to said gun support so as to control rotational movement of said gun support in a first plane, said second actuator and said second directional valve being operably interconnected with each other and to said gun support so as to control rotational movement of said gun support in a second plane which is generally perpendicular to said first plane, whereby the gun can be aimed in multiple directions in more than one plane.

5. An apparatus as defined in claim 4 wherein said control means includes switching valves and a housing mounted to said base containing said switching valves, said switching valves being operably connected to said first and second directional valves, said lever being mounted in said housing for multidirectional movement in a joystick-like arrangement with said switching valves so that when said lever is manipulated said switching valves shift said first and second directional valves to actuate said actuator and move the gun support in the first or second planes and thus aim the gun.

6. An apparatus as defined in claim 5 wherein said one actuator is adapted to be driven by an incompressible fluid.

7. An apparatus as defined in claim 1 including firing means for firing the gun, said firing means being attached to the base and being adapted for use by the wheelchair-bound person.

8. An apparatus as defined in claim 1 wherein said fluid power means includes a compressed air source.

9. An apparatus as defined in claim 8 wherein said at least one actuator is adapted to be driven by an incompressible fluid, and including at least one air/oil chamber operably connected to the compressed air source for converting compressed air fluid flow into incompressible fluid flow, said one air/oil chamber also being operably interconnected with said one actuator, whereby compressed air from the compressed air source can be converted to incompressible fluid flow for powering said one actuator with an advantage of accurate aiming of the gun.

10. An apparatus as defined in claim 9 wherein said control means includes interlock valves operably connected to said one actuator, said control means being operably connected to said interlock valves so as to release said one actuator for movement when it is desired to aim the gun, but further connected so as to re-lock said one actuator in a given desired position once the gun is aimed, said interlock valves increasing the stability and controllability of said control means when aiming the gun.

11. An apparatus as defined in claim 1 wherein said gun support includes a shock absorber for absorbing a part of the recoil shock from firing the gun.

12. An apparatus as defined in claim 1 wherein said at least one actuator includes a rotary actuator for rotating said gun support relative to said base.

13. An apparatus as defined in claim 12 wherein said at least one actuator includes a linear actuator that is operably connected to said gun support and which is extendable to liftingly rotate the gun relative to said base.

14. An apparatus as defined in claim 1 wherein said control means includes a lever, switching valves, and a housing containing said switching valves and said lever, said switching valves being operably connected to said one actuator and said fluid power means, and being positioned about said lever with said lever being mounted in said housing for multidirectional movement in a joystick-like arrangement so that when said lever is manipulated, said switching valves cause fluid power to actuate said one actuator and thus aim the gun.

15. An apparatus for use by a person to aim and fire a gun while sitting in a wheelchair, comprising:

gun support means adapted to attach to the wheelchair for movably supporting the gun on the wheelchair; and a control system for aiming the gun including:

fluid actuating means for aiming the gun operably connected to said gun support means;

portable powering means for powering said fluid actuating means; and valve means for controlling said fluid actuating means, said valve means being operably connected to said portable powering means and said fluid actuating means.

16. An apparatus as defined in claim 15 wherein said fluid actuating means is adapted to be driven by an incompressible fluid.

17. An apparatus as defined in claim 16 wherein said control system includes a lever, and said valve means includes at least one directional valve operably connected to said lever so that by manipulating said lever, said one directional valve can be shifted and the gun can be aimed.

18. An apparatus as defined in claim 15 wherein said fluid actuating means includes a first and a second actuator and a first and a second directional valve, said first actuator and said first directional valve being operably interconnected with each other and to said gun support means so as to control rotational movement of said gun support means in a first plane, said second actuator and said second directional valve being operably interconnected with each other and to said gun support means so as to control rotational movement of said gun support means in a second plane, whereby the gun can be aimed in multiple directions in more than one plane.

19. An apparatus as defined in claim 18 wherein said valve means includes switching valves and a housing mounted to said gun support means and containing said switching valves, said switching valves being operably connected to said first and second directional valves, said switching valves being manipulatable to shift said first and second directional valves to move the gun support means in the first or second planes and thus aim the gun.

20. An apparatus as defined in claim 19 wherein said valve means further includes interlock valves operably connected to said directional valves and controlled by said switching valves so that said interlock valves release when said switching valves are manipulated, but re-lock when said switching valves are not being manipulated, said interlock valves increasing the stability and controllability of said valve means when aiming the gun.

21. An apparatus as defined in claim 15 wherein said portable powering means includes a compressed air source.

22. An apparatus as defined in claim 21 including at least two air/oil chambers for converting compressed air fluid flow into incompressible fluid flow, said fluid actuating means being adapted to be driven by an incompressible fluid, and being operably interconnected with said compressed air source through a selectable one of said at least two air/oil chambers, whereby the compressed air flow from the compressed air source can be converted to the incompressible fluid flow for powering said fluid actuating means such that a volume of the incompressible fluid exiting from said fluid actuating means can be converted to a volume of air and released to atmosphere as said fluid actuating means is moved.

23. An apparatus as defined in claim 15 wherein said portable powering means includes straps for attaching said portable powering means to the wheelchair.

24. A portable control system for aiming a gun operably mounted on a gun support, comprising:

portable fluid actuating means adapted to operably connect to the gun support for aiming the gun located on the gun support;

portable powering means operably connected to said portably fluid actuating means for powering said portable fluid actuating means;

a portable control system to control said portable fluid actuating means, said control system including valve means operably connected to said portable powering means and said portable fluid actuating means for controlling same, said control system further including a lever means operably connected to said valve means and being manipulatable so as to shift said valve means; whereby a person can aim the gun mounted on the gun support by manipulating the lever means so as to control said portable fluid actuating means and, in turn, the gun support; and means for attaching said portable fluid actuating means, said portable powering means, and said portable control system to a wheelchair.

25. An apparatus as defined in claim 24 wherein said portable fluid actuating means is adapted to be driven by an incompressible fluid.

26. An apparatus as defined in claim 25 wherein said valve means includes at least one directional valve operably connected to said lever means so that by manipulating said lever means, said one directional valve can be shifted and the gun can be aimed.

27. An apparatus as defined in claim 26 wherein said portable fluid actuating means includes a first and a second actuator, and wherein said at least one directional valve includes a first and a second directional valve, said first actuator and said first directional valve being operably interconnected with each other and adapted to be connected to the gun support so as to control movement of the gun support in a first plane, said second actuator and said second directional valve being operably interconnected with each other and adapted to be connected to the gun support so as to control movement of the gun support in a second plane, whereby the gun can be aimed in multiple directions in multiple planes.

28. An apparatus as defined in claim 27 wherein said control means includes switching valves and a housing containing said switching valves, said switching valves being operably connected to said first and second directional valves, said lever being mounted in said housing for multidirectional movement in a joystick-like arrangement with said switching valves so that when said lever is manipulated said switching valves shift said first and second directional valves to move the gun support in the first or second planes and thus aim the gun.

29. An apparatus as defined in claim 28 wherein said control means includes interlock valves operably connected to said directional valves and controlled by said switching valves so that said interlock valves release when said lever is manipulated, but re-lock when said lever is not being manipulated, said interlock valves increasing the accuracy and controllability of said control means when aiming the gun.

30. A portable control system for aiming a gun operably mounted on a gun support, comprising:

portable fluid actuating means adapted to operably connect to the gun support for aiming the gun located on the gun support;

portable powering means operably connected to said portable fluid actuating means for powering said portable fluid actuating means; and a portable control system to control said portable fluid actuating means, said control system including valve means operably connected to said portable powering means and said portable fluid actuating means for controlling same, said control system further including a lever means operably connected to said valve means and being manipulatable so as to shift said valve means; whereby a person can aim a gun mounted on the gun support by manipulating the lever means so as to control said portable fluid actuating means and, in turn, the gun support;

said portable powering means including a compressed air source and at least one air/oil chamber for converting compressed air fluid flow into incompressible fluid flow, said at least one air/oil chamber being operably interconnected with said portable fluid actuating means, whereby compressed air from the compressed air source can be converted to hydraulic power for powering said portable fluid actuating means such that the gun may be accurately aimed with a volume of incompressible fluid exiting from said portable fluid actuating means being converted to a volume of air which is released to atmosphere as said portable fluid actuating means is moved.

31. An apparatus as defined in claim 30 wherein said portable fluid actuating means includes a rotary actuator for rotating the gun support relative to said base.

32. An apparatus as defined in claim 31 wherein said portable fluid actuating means includes a linear actuator, said linear actuator being extendable to rotate the gun support relative to said base.

33. An apparatus as defined in claim 30 wherein said control means includes a lever, switching valves and a housing containing said switching valves and said lever, said switching valves being operably connected to said portable fluid actuating means and said portable powering means, and being positioned about said lever with said lever being mounted in said housing for multidirectional movement in a joystick-like arrangement so that when said lever is manipulated, said switching valves cause fluid power to actuate said actuating means and thus aim the gun.

34. A portable control system for aiming a gun operably mounted on a gun support, comprising:

portable fluid actuating means adapted to operably connect to the gun support for aiming the gun located on the gun support;

portable powering means operably connected to said portable fluid actuating means for powering said portable fluid actuating means;

a portable control system to control said portable fluid actuating means, said control system including valve means operably connected to said portable powering means and said portable fluid actuating means for controlling same, said control system further including a lever means operably connected to said valve means and being manipulatable so as to shift said valve means; whereby a person can aim a gun mounted on the gun support by manipulating the lever means so as to control said portable fluid actuating means and, in turn, the gun support; and straps and a pack for mounting said portable powering means to a wheelchair.

* * * * *

UNITED STATES PATENT AND TRADEMARK OFFICE

CERTIFICATE OF CORRECTION

PATENT NO. : 5,272,955
DATED : December 28, 1993
INVENTOR(S) : Robert L. Bond and Bradford S. Bachelder It is certified that error appears in the above-indentified patent and that said Letters Patent is hereby corrected as shown below:

Column 1, line 22;
After "controls" insert --.--.

Column 5, line 8;
After "atmosphere" insert --.--.

Column 7, line 26;
"such .as" should be --such as--.

Column 8, line 50;
"for sue" should be --for use--.

Column 11, line 33;
"portably" should be --portable--.

Column 11, line 50;
"claim 24" should be --claim 30--.

Signed and Sealed this

Nineteenth Day of July, 1994

*Attest:*

*Attesting Officer*

BRUCE LEHMAN

*Commissioner of Patents and Trademarks*